US011457714B2

(12) United States Patent
Rocha et al.

(10) Patent No.: US 11,457,714 B2
(45) Date of Patent: Oct. 4, 2022

(54) HANDS-FREE HAIR DRYER WITH USER-SELECTABLE OSCILLATION MODES

(71) Applicants: Michael Rocha, Playa del Rey, CA (US); Kent Yu, Santa Monica, CA (US); Paul Pofcher, Santa Monica, CA (US)

(72) Inventors: Michael Rocha, Playa del Rey, CA (US); Kent Yu, Santa Monica, CA (US); Paul Pofcher, Santa Monica, CA (US)

(73) Assignee: T3 MICRO, INC., Venice, CA (US)

( * ) Notice: Subject to any disclaimer, the term of this patent is extended or adjusted under 35 U.S.C. 154(b) by 347 days.

(21) Appl. No.: 16/926,635

(22) Filed: Jul. 10, 2020

(65) Prior Publication Data

US 2020/0352304 A1 Nov. 12, 2020

Related U.S. Application Data

(63) Continuation-in-part of application No. 16/241,920, filed on Jan. 7, 2019, now abandoned, which is a continuation-in-part of application No. PCT/US2017/041185, filed on Jul. 7, 2017.

(60) Provisional application No. 62/360,069, filed on Jul. 8, 2016.

(51) Int. Cl.
*A45D 20/14* (2006.01)
*A45D 24/10* (2006.01)

(52) U.S. Cl.
CPC ..... *A45D 20/14* (2013.01); *A45D 24/10* (2013.01)

(58) Field of Classification Search
CPC ..... A45D 20/14; A45D 24/10
See application file for complete search history.

(56) References Cited

U.S. PATENT DOCUMENTS

| | | | |
|---|---|---|---|
| 4,712,313 | A | 12/1987 | Gettleman |
| 5,172,880 | A | 12/1992 | McDougall |
| 5,268,988 | A | 12/1993 | Miyamoto et al. |
| 5,279,048 | A | 1/1994 | Lawall et al. |
| 5,332,181 | A | 7/1994 | Schweizer et al. |

(Continued)

FOREIGN PATENT DOCUMENTS

| | | | |
|---|---|---|---|
| CN | 201908856 | U | 7/2011 |
| CN | 105831950 | A | 8/2016 |

(Continued)

*Primary Examiner* — Jessica Yuen
(74) *Attorney, Agent, or Firm* — Barcelo, Harrison & Walker, LLP; Joshua C. Harrison

(57) ABSTRACT

A hair dryer system includes a hands-free dryer having a base, an air flow generator that causes an air flow, and a heating element in contact with the air flow. The hands-free dryer includes a nozzle through which the air flow exits the hair dryer, and an actuator that is physically coupled to the base and to the nozzle, and that moves the nozzle in at least one degree of freedom relative to the base. The hands-free dryer includes an actuator driver circuit that drives the actuator according to a user-selected one of a plurality of stored alternative user-selectable oscillation modes. The hair dryer system also includes a user interface, optionally pertaining to a hair-styling tool, that is in communication with the actuator driver circuit. The communication identifies to the actuator driver circuit the user-selected one of the plurality of stored alternative user-selectable oscillation modes.

19 Claims, 4 Drawing Sheets

(56) References Cited

U.S. PATENT DOCUMENTS

| | | | | |
|---|---|---|---|---|
| 5,345,087 | A | 9/1994 | Luber et al. | |
| 5,386,644 | A | 2/1995 | Lawall et al. | |
| 5,592,749 | A | 1/1997 | Trimmer | |
| 5,613,305 | A | 3/1997 | Narrin | |
| 5,636,815 | A | 6/1997 | Wilson | |
| 5,640,781 | A | 6/1997 | Carson | |
| 5,737,847 | A | 4/1998 | Britton | |
| 5,881,983 | A | 3/1999 | Hofmann | |
| 5,937,537 | A | 8/1999 | Miller | |
| 5,940,980 | A | 8/1999 | Lee et al. | |
| 6,199,805 | B1 | 3/2001 | Pena | |
| 6,457,686 | B1 | 10/2002 | Hill | |
| 6,520,467 | B2 | 2/2003 | Thomas | |
| 6,966,125 | B2 | 11/2005 | Rago et al. | |
| 8,081,873 | B2 | 12/2011 | Dannenberg et al. | |
| 8,302,324 | B1 | 11/2012 | Connelly | |
| 9,408,452 | B1 | 8/2016 | Al-Khulaifi | |
| 10,021,952 | B2 | 7/2018 | Goldman et al. | |
| 10,117,492 | B2 | 11/2018 | Karbakhsh | |
| 2003/0103767 | A1* | 6/2003 | Kakuya | A45D 20/20 392/419 |
| 2006/0076464 | A1 | 4/2006 | Van | |
| 2009/0282691 | A1 | 11/2009 | Anicetti | |
| 2011/0079239 | A1 | 4/2011 | Hall | |
| 2012/0324755 | A1 | 12/2012 | Zhao | |
| 2015/0100037 | A1 | 4/2015 | Allsup | |
| 2018/0103741 | A1 | 4/2018 | Karbakhsh | |
| 2019/0133289 | A1* | 5/2019 | Rocha | A45D 20/16 |

FOREIGN PATENT DOCUMENTS

| | | | |
|---|---|---|---|
| CN | 106666983 | A | 5/2017 |
| CN | 107668898 | A | 2/2018 |
| GB | 2422105 | A | 7/2006 |
| KR | 0131822 | Y1 | 12/1998 |

* cited by examiner

HANDS-FREE HAIR DRYER WITH USER-SELECTABLE OSCILLATION MODES

CROSS-REFERENCE TO RELATED APPLICATIONS

This application claims priority under 35 USC § 120 as a continuation-in part to pending U.S. patent application Ser. No. 16/241,920 filed on 2019 Jan. 7, and published on 2019 May 9 as U.S. Patent App. Pub. 2016/0133289A1, entitled "Hands-Free Motion-Tracking Hair Dryer System," which itself claims priority under 35 USC § 365(c) and 35 USC § 120 as a continuation-in part to the international application PCT/US2017/041185 filed on 2017 Jul. 7, and published on 2018 Jan. 11 as WO 2018/009859A1 entitled "Motion Sensing Hair Dryer," which, in turn, claims priority to U.S. Provisional App. 62/360,069 filed 2016 Jul. 8.

BACKGROUND

Hands-free hair dryer systems have been disclosed in the art, but often they comprise mere fixtures or stands to hold a conventional hand-held hair dryer at a desired location in space. However, a heated air flow held steady to follow a fixed path may undesirably overheat the hair at a static target location. Where conventional hands-free hair dryer systems have provided motion, the systems have often been unnecessarily complex, expensive, bulky, or inconvenient to use.

The market for all types of hair dryers is competitive, so that innovations may substantially increase sales volume, price, profit, or market share. Hence, there is a need in the art for an improved hands-free hair drying system that may have reduced weight, size, manufacturing cost, drying time, or risk of hair damage, or that can improve the final hair styling result or convenience of use.

SUMMARY

A hair dryer system includes a hands-free dryer having a base, an air flow generator that causes an air flow, and a heating element in contact with the air flow. The hands-free dryer includes a nozzle through which the air flow exits the hair dryer, and an actuator that is physically coupled to the base and to the nozzle, and that moves the nozzle in at least one degree of freedom relative to the base. The hands-free dryer includes an actuator driver circuit that drives the actuator according to a user-selected one of a plurality of stored alternative user-selectable oscillation modes. The hair dryer system also includes user interface, optionally pertaining to a hair-styling tool, that is in communication with the actuator driver circuit. The communication identifies to the actuator driver circuit the user-selected one of the plurality of stored alternative user-selectable oscillation modes.

BRIEF DESCRIPTION OF THE DRAWINGS

For the purposes of illustration rather than limitation, certain example embodiments are depicted in the figures.

DESCRIPTION OF EXAMPLE EMBODIMENTS

The present application discloses a hands-free hair dryer system in which at least the air flow nozzle is actuated to exhibit oscillatory motion along at least one degree of freedom, and according to a user-selected one of a plurality of oscillation modes. The hands-free hair dryer system may include and communicate with an integral, attached, or remote controller to enable the user to conveniently select among a plurality of hair dryer oscillatory motion modes, or control the air flow, air flow motion, temperature, etc. For example, a remote control may be incorporated into a hair styling tool (e.g. hair brush), and have a user interface disposed on the hair styling tool.

The inventors herein discovered that not all directions of hair dryer nozzle oscillation are equally important while styling hair, so that a subset of directions may instead be manually set once by the user and not automatically actuated thereafter. Such embodiments in which the number of degrees-of-freedom required for nozzle oscillation have been reduced (e.g. allowing initial user-set positioning in three dimensions, but actively oscillating the air flow along or about only one axis) may provide improved system simplicity and manufacturability, and reduced cost and size. Depending on the configuration of the hair dryer, the most-preferred single degree of freedom of oscillation may be a translation along a selected axis, or a rotation about a selected axis, and it is contemplated herein that the selection of the most-preferred axis may be different for different hair dryer configurations.

Figure 1:
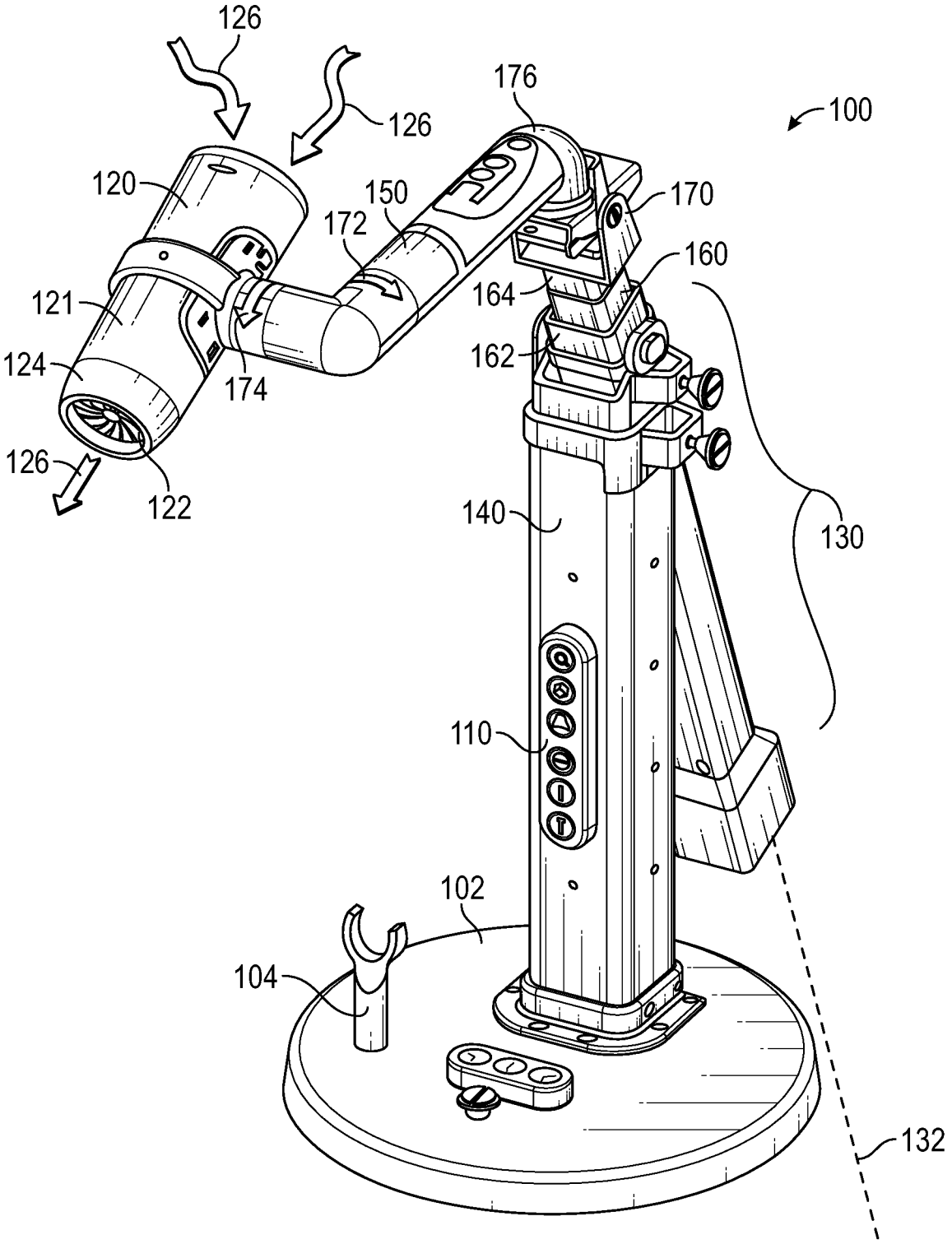
FIG. 1 depicts a hands-free hair dryer according to an example embodiment of the present invention.

FIG. 1 depicts a hands-free hair dryer system according to an example embodiment of the present invention. The hands-free hair dryer system of FIG. 1 includes a hands-free dryer 100 that has a base 102 that may optionally passively swivel when rotated in-plane by a user, or be actuated to swivel in-plane as commanded by a user through a user interface 110, which may optionally include a plurality of buttons or other controls operable by the user's fingers. In certain alternative embodiments, the base 102 can include a conventional clamp, magnet, or suction cup for anchoring to a surface or furnishing in the home.

In the embodiment of FIG. 1, the hands-free dryer 100 includes a distal dryer head 120 that includes a housing 121 that internally includes an air flow generator (e.g. a conventional electric motor that turns a conventional fan or propeller 122) which causes an air flow 126. In the example embodiment of FIG. 1, an exit nozzle 124 is attached to the housing 121 of the distal dryer head 120, and the air flow 126 exits the hands-free dryer 100 via the exit nozzle 124. The hands-free dryer 100 also includes one or more conventional electrical heating elements that are in contact with the air flow 126, preferably internally within the distal dryer head 120. For example, the heating element may be an electrical conductor having resistance, so that heat is generated proportionally to an electrical current therethrough. In certain embodiments, the conventional electrical heating element may be disposed within the housing 121 or within the nozzle 124. The user interface 110 may optionally communicate user adjustments to an electrical current supplied to the heating element, which would adjust the output of the heating element. The user interface 110 may optionally communicate user adjustments to the rotation rate of the electric fan 122.

In the embodiment of FIG. 1, the hands-free dryer 100 includes a telescoping actuator 130 that is physically coupled to the base via a fixed base extension 140, and is also physically coupled to the exit nozzle 124 via a distal member 150 and its distal dryer head 120. Physically "coupled" as used herein does not require direct attachment, but also contemplates indirect coupling through other components of the hands-free dryer 100. For example, the exit nozzle 124 is considered to be physically coupled to the base 102, even though it is not directly attached to the base 102, but rather is attached to another component, that is ultimately coupled to the base, perhaps through other components of the hands-free dryer 100.

In the embodiment of FIG. 1, the hands-free dryer 100 further comprises a support arm 160 having a first portion 162 that is coupled to the base 102 via the fixed base extension 140, and a second portion 164 that is coupled to the nozzle 124 via the distal member 150 and its distal dryer head 120. In the embodiment of FIG. 1, the first portion 162 of the support arm 160 is optionally pivotably attached to the fixed base extension 140, so that its angle with respect to a plane of the base 102 may be manually adjusted by the user. In the example embodiment of FIG. 1, the distal member 150 is attached to the second portion 164 of the support arm 160, and the distal member 150 includes three angular deflection joints 170, 172, and 174—each allowing the user to manually orient the nozzle 124 in a desired angular relationship to the second portion 164 of the support arm 160. The distal member 150 also optionally includes a bend 176 to orient the nozzle 124 towards a direction that is transverse to a longitudinal axis 132 of the support arm 160.

In the embodiment of FIG. 1, the telescoping actuator 130 translates the second portion 164 of the support arm 160 axially with respect to the first portion 162. The second portion 164 of the support arm 160 is optionally telescopically coupled to the first portion 162, which telescopic coupling permits the support arm 160 to change its length. In this way, the telescoping actuator 130 can move the distal dryer head 120 and the nozzle 124 relative to the base 102, in a direction parallel to the telescoping actuator 130 (i.e. parallel to the support arm 160). For example, the telescoping actuator 130 may include a conventional solenoid that is driven by an actuator driver circuit that provides a current to the solenoid that is varied according to a user-selected one of a plurality of stored alternative user-selectable oscillation modes.

Alternatively, for example, the telescoping actuator 130 may include a conventional stepper motor that drives a pinion gear and that is attached to the first portion 162 of the support arm 160, and a rack gear that is attached to the second portion 164 of the support arm 160 and that is engaged with the pinon gear. In such embodiments, the conventional stepper motor may be driven by an actuator driver circuit that provides impulses to the stepper motor that are varied according to a user-selected one of a plurality of stored alternative user-selectable oscillation modes.

The hands-free hair dryer system of FIG. 1 includes the user interface 110, which is optionally attached or integral to the fixed base extension 140 of the hands-free dryer 100. In certain alternative embodiments, the user interface 110 may be attached or integral to the base 102. The user interface 110 is in communication with the driver circuit of the telescoping actuator 130, and the communication identifies to the actuator driver circuit a user-selected one of a plurality of stored alternative user-selectable oscillation modes. In certain embodiments, each of the plurality of stored alternative user-selectable oscillation modes may be distinguished from each other by a difference in oscillation stroke, oscillation frequency, a movement rate, and/or an inter-stroke delay period.

In certain embodiments, the actuator driver circuit may include a memory that stores the alternative user-selectable oscillation modes, and the user interface 110 may communicate programming information to the actuator driver circuit to define the stored alternative user-selectable oscillation modes. In certain alternative embodiments, the user interface 110 may include the memory for storing the alternative user-selectable oscillation modes, and the user interface 110 may identify to the driver circuit of the telescoping actuator 130 the user-selected one of the alternative user-selectable oscillation modes by recalling and transmitting one or more motion parameters corresponding to the user-selected one of the alternative user-selectable oscillation modes.

In certain embodiments, the user interface 110 may be attached or integral to a hair styling tool that is held in the user's hand, rather than or in addition to being attached directly to the hands-free dryer 100. In such embodiments, the hair styling tool may be a hair brush, a comb, or a hair curler, or a different hair styling tool. The hands-free hair dryer system may optionally use both fixed and hand-held user interfaces in parallel, with partially or completely redundant function.

Figure 2:
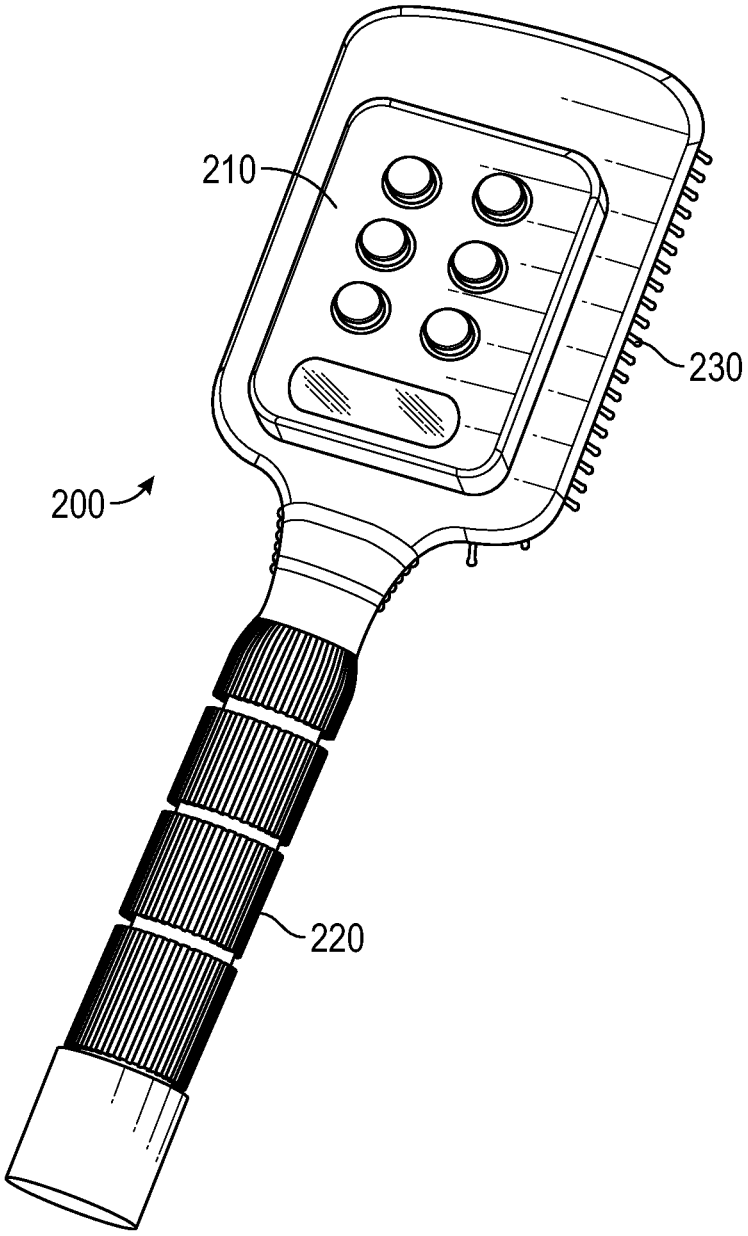
FIG. 2 depicts a hand-held styling tool that includes the user interface that may be used in conjunction with a hands-free hair dryer, according to an example embodiment of the present invention.

For example, FIG. 2 depicts a hand-held styling tool 200 that includes a handle 220 and a hair brush 230. The hand-held styling tool 200 also includes a user interface 210 that may pertain to and be used in conjunction with the hands-free hair dryer system of FIG. 1, instead of, or with partial or complete redundant function as, the user interface 110 of FIG. 1. The hand-held styling tool 200 is not physically coupled to the hands-free dryer 100 during use, but the base 102 of the hands-free dryer 100 may optionally include a holder 104 to stow the hair styling tool 200 when not in use. Preferably, for example, the user interface 210 may be in wireless communication with the driver circuit of the telescoping actuator 130 of the hands-free dryer 100, with the communication identifying to the actuator driver circuit a user-selected one of a plurality of stored alternative user-selectable oscillation modes. In certain embodiments, the optional holder 104 may include a conventional electrical charger to which the hand-held styling tool 200 docks, to maintain stored energy in a conventional battery in the hand-held styling tool 200 (e.g. to power the user interface 210 or its wireless communications with the hands-free dryer 100).

Figure 3:
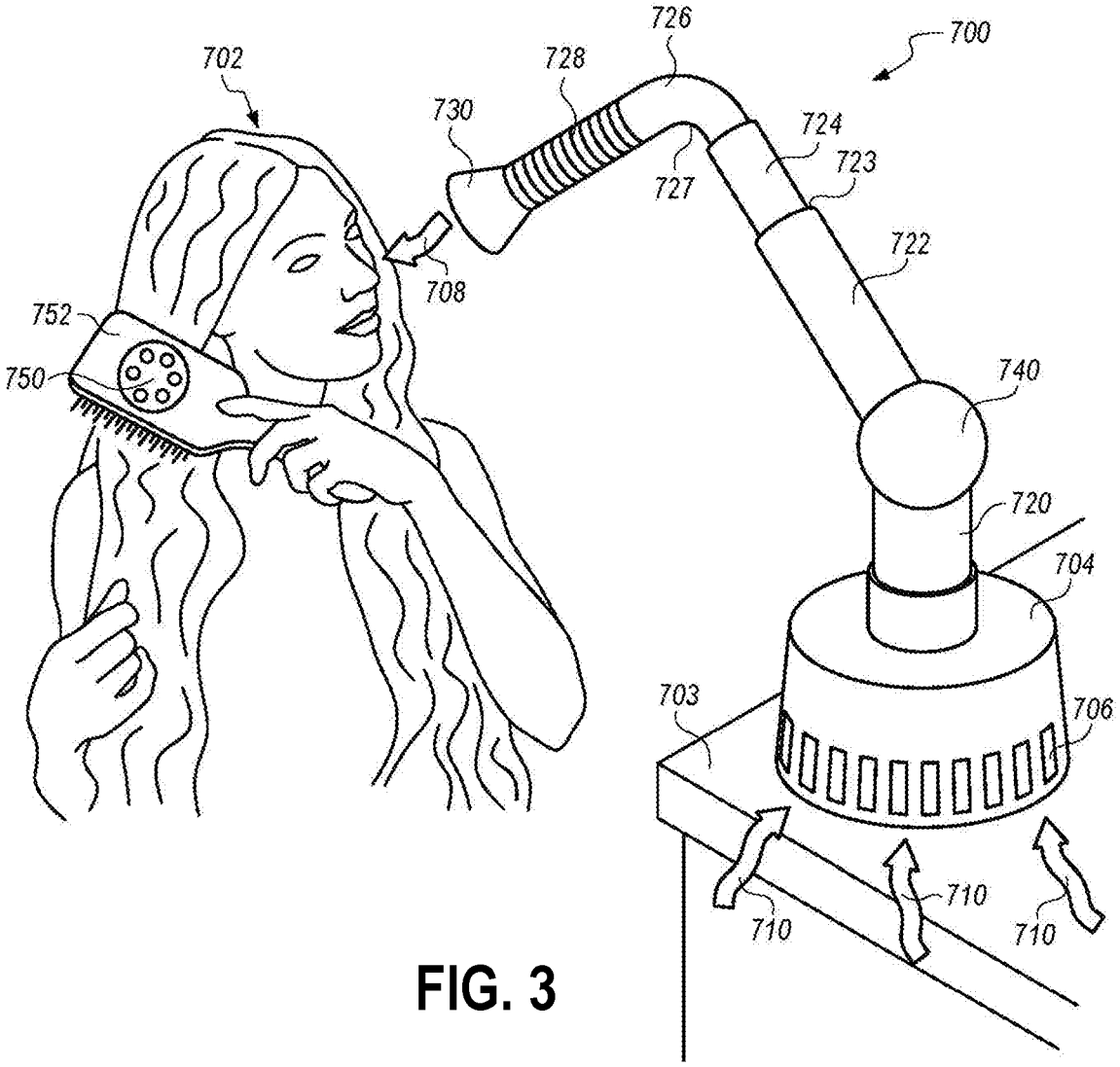
FIG. 3 depicts a hands-free hair dryer system according to another example embodiment of the present invention.

FIG. 3 depicts a hands-free hair dryer system 700 according to another example embodiment of the present invention. The hands-free hair dryer system 700 of FIG. 3 includes a base 704 that houses an air flow generator 706 to generate an inlet airflow 710 and an outlet airflow 708. For example, the air flow generator 706 may be a conventional motorized fan (e.g. an axial or centrifugal fan or blower), or another conventional means to generate air flow (e.g. an electrostatic fluid flow generator), which produces an outlet airflow having a velocity in the range 8 m/s to 16 m/s. The stationary base 704 optionally may be supported by a household surface 703, for example by being weighted and resting on the surface 703 or being attached to a similar horizontal or vertical surface, and does not need to be held by the hands of the user 702.

In the embodiment of FIG. 3, the hands-free hair dryer system 700 includes a conduit 720, 722, 724, 726 through which the air flow 708, 710 passes and that channels the air flow 708, 710 to an exit nozzle 730. The conduit may include a telescoping joint 723 that permits longitudinal translation (e.g. driven by a motorized, pneumatic, or hydraulic actuator) between a first support arm portion 722 that is coupled to the base 704 via a fixed base extension 720, and a second support arm portion 724 that is coupled to the nozzle 730 via a distal conduit member 726.

In the embodiment of FIG. 3, the first support arm portion 722 is optionally pivotably attached to the fixed base extension 720 via an angular deflection joint 740 (e.g. a hollow ball joint having three angular degrees of freedom, or a hollow hinge joint having one or two angular degrees of freedom, etc.) that allows the user to manually orient a longitudinal axis of the support arm 722, 724 in a desired angular direction with respect to the base 704. The angular deflection joint 740 optionally may be disposed between the air flow generator 706 and the telescoping joint 723, as shown in FIG. 3. Alternatively, the angular deflection joint 740 may be disposed between the telescoping joint 723 and the outlet nozzle 730, although that is less preferred because it would increase the moving mass of the actuated distal portions 724, 726 of the conduit.

In the embodiment of FIG. 3, the second support arm portion 724 is optionally telescopically coupled to the first support arm portion 722 at a telescoping joint 723, which permits the support arm 722, 724 to change its length while the air flow 708, 710 passes therethrough. The telescoping joint 723 preferably allows an actuator to translate the second support arm portion 724 axially with respect to the first support arm portion 722 to move the nozzle 730 relative to the base 704, in a direction parallel to the longitudinal axis of the support arm 722, 724. For example, the telescoping actuator may include a conventional solenoid that is driven by an actuator driver circuit that provides a current to the solenoid that is varied according to a user-selected one of a plurality of stored alternative user-selectable oscillation modes. For example, the longitudinal translation may be driven at a rate of 150 mm/sec to 275 mm/sec to change the conduit length by a maximum change in the range of 100 mm to 400 mm.

Alternatively, for example, the actuator driving translation of the second support arm portion 724 relative to the first support arm portion 722 may include a conventional stepper motor that drives a pinion gear and that is attached to the first support arm portion 722, and a rack gear that is attached to the second support arm portion 724 and that is engaged with the pinon gear. In such embodiments, the conventional stepper motor may be driven by an actuator driver circuit that provides impulses to the stepper motor that are varied according to a user-selected one of a plurality of stored alternative user-selectable oscillation modes.

In the example embodiment of FIG. 3, the distal conduit member 726 is attached to the second support arm portion 724, and the distal member 726 optionally includes a flexible portion 728 that can be bent and thereby serve as an angular deflection joint allowing the user 702 to manually orient the nozzle 730 in a desired angular relationship to the second support arm portion 724. The distal member 726 also optionally includes a bend 727 to orient the nozzle 730 towards a direction that is transverse to the longitudinal axis of the support arm 722, 724. Such transverse orientation of the nozzle 730 may be desirable so that longitudinal actuation of the telescoping portion 724 to change the length of the conduit will move the outlet air flow 708 in a transverse direction, and thereby change the location of its impingement on the user 702. Otherwise, if the outlet air flow 708 were parallel with the longitudinal axis of the telescoping portions 722, 724, then the location of air flow impingement on the user 702 would not move, but rather merely become more concentrated (nozzle 730 closer to the user 702) or more diffuse (nozzle 730 further away from the user 702).

In the example embodiment of FIG. 3, the outlet air flow 708 exits the hands-free dryer 700 via the exit nozzle 730. The hands-free dryer 700 also includes one or more conventional electrical heating elements that are in contact with the air flow internally within the hands-free dryer 700, downstream of the entrance air flow 710 and upstream of the outlet air flow 708. For example, the heating element may be an electrical conductor having resistance, so that heat is generated proportionally to an electrical current therethrough. The conventional electrical heating element may be disposed within the exit nozzle 730 or adjoining conduit in certain embodiments. In such embodiments, most of the length of the conduit is advantageously not incidentally heated by the air flow 708. Alternatively, the conventional heating element may be disposed in or adjacent the stationary base 704 or the air flow generator 706 (e.g. in conduit portion 720). In such embodiments, the conventional heating element advantageously does not add moving mass to the actuated conduit portions 724, 726. In certain embodiments, the conventional heating element may be selectively powered to result in an air flow temperature in the range of room temperature to 90° C.

The hands-free hair dryer system 700 of FIG. 3 includes a user interface 750, which is optionally attached or integral to a hair styling tool 752 that is held in the hand of the user 702 during use. In certain embodiments, the hair styling tool may be a hair brush, a comb, or a hair curler, or a different hair styling tool. The hand-held styling tool 752 is not physically coupled to the hands-free dryer during use, but the base 704 of the hands-free dryer 700 may optionally include a holder to stow the hair styling tool 752 when not in use. Preferably, for example, the user interface 750 may be in wireless communication with a driver circuit of the actuator that lengthens or shortens the support arm 722, 724 at the telescoping joint 723, with the communication identifying to the actuator driver circuit a user-selected one of a plurality of stored alternative user-selectable oscillation modes. The user interface 750 may also optionally communicate user adjustments to an electrical current supplied to the heating element, which would adjust the output of the heating element. The user interface 750 may also optionally communicate user adjustments to the rotation rate of the electric blower or fan of the air flow generator 706.

In certain embodiments, each of the plurality of stored alternative user-selectable oscillation modes may be distinguished from each other by a difference in oscillation stroke, oscillation frequency, a movement rate, and/or an inter-stroke delay period. In certain embodiments, the actuator driver circuit may include a memory that stores the alternative user-selectable oscillation modes, and the user interface 750 may communicate programming information to the actuator driver circuit to define the stored alternative user-selectable oscillation modes. In certain alternative embodiments, the user interface 750 may include the memory for storing the alternative user-selectable oscillation modes, and the user interface 750 may identify to the actuator driver circuit the user-selected one of the alternative user-selectable oscillation modes by recalling and transmitting one or more motion parameters corresponding to the user-selected one of the alternative user-selectable oscillation modes.

Figure 4:
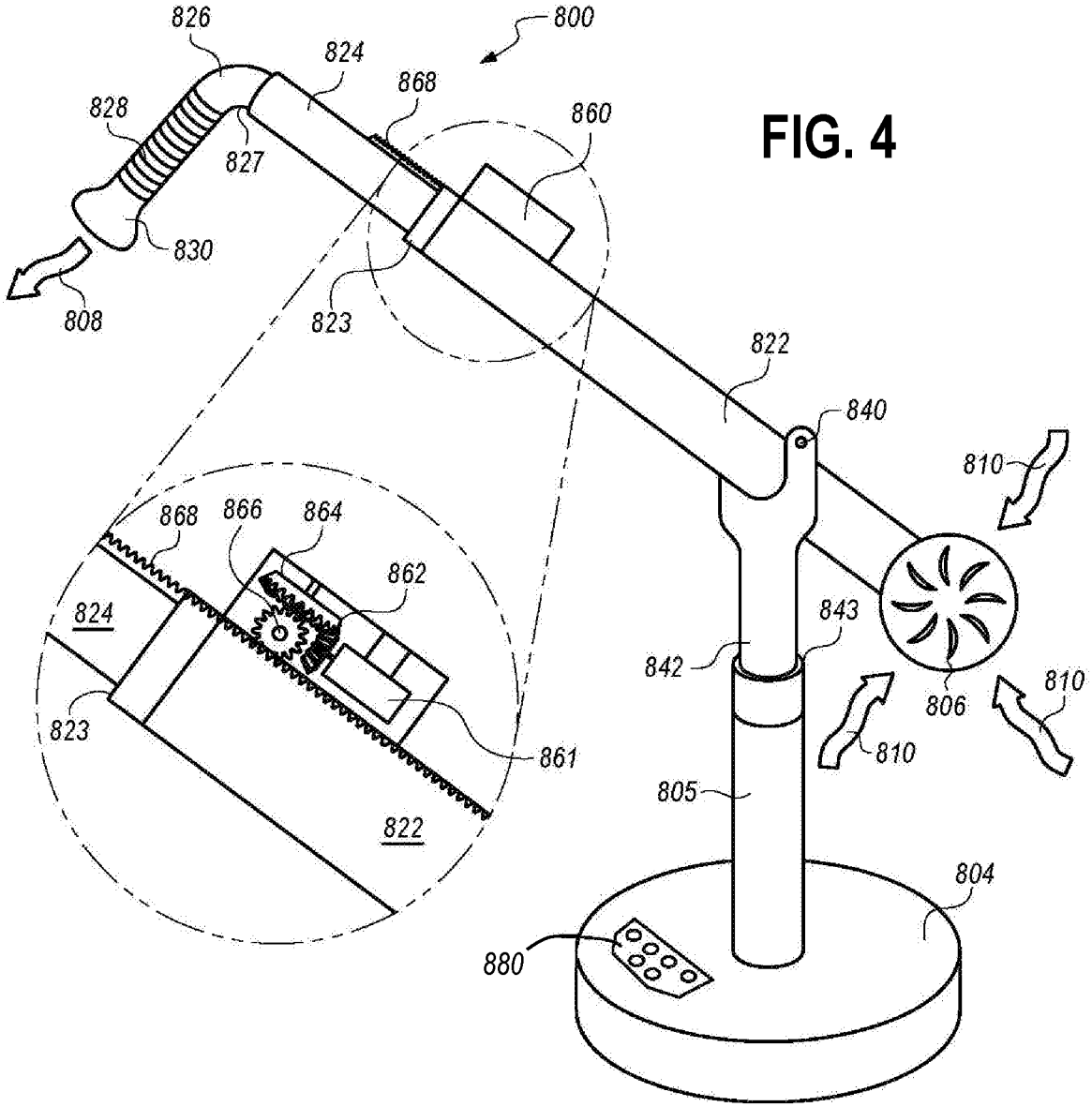
FIG. 4 depicts a hands-free hair dryer according to another example embodiment of the present invention.

FIG. 4 depicts a hands-free hair dryer 800 according to another example embodiment of the present invention. The hands-free hair dryer 800 of FIG. 4 includes a base 804, and a support arm comprising a first support arm portion 822 and a second support arm portion 824. An air flow generator 806 is attached to the second support arm portion 824 and generate an inlet airflow 810 and an outlet airflow 808. For example, the air flow generator 806 may be a conventional motorized fan (e.g. an axial or centrifugal fan or blower), or another conventional means to generate air flow (e.g. an electrostatic fluid flow generator), which produces an outlet airflow having a velocity in the range 8 m/s to 16 m/s.

In the embodiment of FIG. 4, the first support arm portion 822 and the second support arm portion 824 form a conduit that, together with a distal conduit member 826, channels the air flow 808, 810 to an exit nozzle 830. The conduit may include a telescoping joint 823 that permits longitudinal translation (e.g. driven by a motorized, pneumatic, or hydraulic actuator) between the first support arm portion 822 that is coupled to the base 804 via a base extension 805, 842, and the second support arm portion 824 that is coupled to the nozzle 830 via the distal conduit member 826. The base extension 805, 842 can optionally be two telescoping components having a length that can be adjusted manually at base telescoping joint 843 to provide an additional degree of freedom of manual adjustment (i.e. adjustment of the height of the first support arm portion 822).

In the embodiment of FIG. 4, the first support arm portion 822 is optionally pivotably attached to an upper member of the adjustable-length base extension 842 via an angular deflection joint 840 that allows the user to manually orient a longitudinal axis of the support arm 822, 824 in a desired angular direction with respect to the base 804. The second support arm portion 824 is optionally telescopically coupled to the first support arm portion 822 at the telescoping joint 823, which permits the support arm 822, 824 to change its length while the air flow 808, 810 passes therethrough.

The telescoping joint 823 preferably allows an actuator 860 to translate the second support arm portion 824 axially with respect to the first support arm portion 822 to move the nozzle 830 relative to the base 804, in a direction parallel to the longitudinal axis of the support arm 822, 824. For example, the actuator 860 driving translation of the second support arm portion 824 relative to the first support arm portion 822 may include an electrically-driven stepper motor 861 that drives a pinion gear 866 (e.g. via transfer gears 862 and 864), and that is attached to the non-actuated the first support arm portion 822 of the conduit. The actuated second support arm portion 824 of the conduit may include an attached linear rack gear 868 that is engaged with the pinon gear 866, so that it can be automatically telescopically actuated relative to the non-actuated first support arm portion 822 of the conduit. The stepper motor 861 may be driven by an actuator driver circuit that provides impulses to the stepper motor 861 that are varied according to a user-selected one of a plurality of stored alternative user-selectable oscillation modes. For example, the longitudinal translation may be driven at a rate of 150 mm/sec to 275 mm/sec to change the conduit length by a maximum change in the range of 100 mm to 400 mm.

In the example embodiment of FIG. 4, the distal conduit member 826 is attached to the second support arm portion 824, and the distal member 826 optionally includes a flexible portion 828 that can be bent and thereby serve as an angular deflection joint allowing the user to manually orient the nozzle 830 in a desired angular relationship to the second support arm portion 824. The distal member 826 also optionally includes a bend 827 to orient the nozzle 830 towards a direction that is transverse to the longitudinal axis of the support arm 822, 824.

In the example embodiment of FIG. 4, the outlet air flow 808 exits the hands-free dryer 800 via the exit nozzle 830. The hands-free dryer 800 also includes one or more conventional electrical heating elements that are in contact with the air flow internally within the hands-free dryer 800, downstream of the entrance air flow 810 and upstream of the outlet air flow 808. For example, the heating element may be an electrical conductor having resistance, so that heat is generated proportionally to an electrical current therethrough. The conventional electrical heating element may be disposed within the exit nozzle 830 or adjoining conduit in certain embodiments. In such embodiments, most of the length of the conduit is advantageously not incidentally heated by the air flow 808. Alternatively, the conventional heating element may be disposed in the first support arm portion 822 adjacent to the air flow generator 806. In such embodiments, the conventional heating element advantageously does not add moving mass to the actuated conduit portions 824, 826. In certain embodiments, the conventional heating element may be selectively powered to result in an air flow temperature in the range of room temperature to 90° C.

The hands-free hair dryer system 800 of FIG. 4 includes a user interface 880, which is optionally integral to the base 804. The user interface 880 is in communication with a driver circuit of the actuator 860 that lengthens or shortens the support arm 822, 824, with the communication identifying to the actuator driver circuit a user-selected one of a plurality of stored alternative user-selectable oscillation modes. The user interface 880 may also optionally communicate user adjustments to an electrical current supplied to the heating element, which would adjust the output of the heating element. The user interface 880 may also optionally communicate user adjustments to the rotation rate of the electric blower or fan of the air flow generator 806.

In certain embodiments, each of the plurality of stored alternative user-selectable oscillation modes may be distinguished from each other by a difference in oscillation stroke, oscillation frequency, a movement rate, and/or an inter-stroke delay period. In certain embodiments, the actuator driver circuit may include a memory that stores the alternative user-selectable oscillation modes, and the user interface 880 may communicate programming information to the actuator driver circuit to define the stored alternative user-selectable oscillation modes. In certain alternative embodiments, the user interface 880 may include the memory for storing the alternative user-selectable oscillation modes, and the user interface 880 may identify to the actuator driver circuit the user-selected one of the alternative user-selectable oscillation modes by recalling and transmitting one or more motion parameters corresponding to the user-selected one of the alternative user-selectable oscillation modes.

In the foregoing specification, the invention is described with reference to specific exemplary embodiments, but those skilled in the art will recognize that the invention is not limited to those. It is contemplated that various features and aspects of the invention may be used individually or jointly and possibly in a different environment or application. The specification and drawings are, accordingly, to be regarded as illustrative and exemplary rather than restrictive. For example, the word "preferably" is used herein to consistently include the meaning of "not necessarily" or optionally. "Comprising," "including," and "having," are intended to be open-ended terms.

We claim:

1. A hair dryer system comprising:

a hands-free dryer that comprises a base;

an air flow generator that causes an air flow;

a heating element in contact with the air flow;

a nozzle through which the air flow exits the hair dryer;

an actuator that is physically coupled to the base and to the nozzle and that moves the nozzle in at least one degree of freedom relative to the base; and an actuator driver circuit that drives the actuator according to a user-selected one of a plurality of stored alternative user-selectable oscillation modes; and a user interface that is in communication with the actuator driver circuit, the communication identifying to the actuator driver circuit the user-selected one of the plurality of stored alternative user-selectable oscillation modes.

2. The hair dryer system of claim 1, further comprising a hand-held styling tool that includes the user interface, the user interface being in wireless communication with the actuator driver circuit.

3. The hair dryer system of claim 2 wherein the hand-held styling tool is not physically coupled to the hands-free dryer during use.

4. The hair dryer system of claim 3 wherein the base includes a holder to stow the hair styling tool when not in use.

5. The hair dryer system of claim 2 wherein the hair styling tool is one of a hair brush, a comb, and a hair curler.

6. The hair dryer system of claim 2 wherein the user interface of the hair styling tool can communicate user adjustments to the output of the heating element.

7. The hair dryer system of claim 2 wherein the air flow generator is an electric fan, and the user interface of the hair styling tool can communicate user adjustments to the rotation rate of the electric fan.

8. The hair dryer system of claim 1, wherein the user interface is disposed on the base.

9. The hair dryer system of claim 1, further comprising a support arm having a first portion that is coupled to the base, and a second portion that is coupled to the nozzle, the actuator translating the second portion of the support arm axially with respect to the first portion of the support arm.

10. The hair dryer system of claim 9, further comprising a fixed base extension, the first portion of the support arm being pivotably attached to the fixed base extension.

11. The hair dryer system of claim 9, further comprising a distal member attached to the second portion of the support arm, the distal member including an angular deflection joint that allows the user to manually orient the nozzle in a desired angular relationship to the second portion of the support arm.

12. The hair dryer system of claim 11, wherein the distal member comprises a bend to orient the nozzle towards a direction that is transverse to a longitudinal axis of the support arm.

13. The hair dryer system of claim 11, wherein the distal member includes a housing that includes the air flow generator and the heating element, the nozzle being attached to the housing.

14. The hair dryer system of claim 9, wherein the second portion of the support arm is telescopically coupled to the first portion of the support arm, the telescopic coupling permitting the support arm to change its length.

15. The hair dryer system of claim 1, wherein the air flow generator is disposed in the base.

16. The hair dryer system of claim 1, wherein the heating element is disposed in the nozzle.

17. The hair dryer system of claim 1 wherein the actuator driver circuit includes a memory that stores the alternative user-selectable oscillation modes, and the user interface can communicate programming information to the actuator driver circuit to define the stored alternative user-selectable oscillation modes.

18. The hair dryer system of claim 1 wherein each of the plurality of stored alternative user-selectable oscillation modes is defined by a difference in at least one motion parameter selected from the group consisting of an oscillation stroke, an oscillation frequency, a movement rate, and an inter-stroke delay period.

19. The hair dryer system of claim 1 wherein the user interface includes a memory that stores the alternative user-selectable oscillation modes, and the user interface identifies to the actuator driver circuit the user-selected one of the alternative user-selectable oscillation modes by recalling and transmitting one or more motion parameters corresponding to the user-selected one of the alternative user-selectable oscillation modes.

* * * * *